US007004544B2

(12) United States Patent
Mitjans

(10) Patent No.: US 7,004,544 B2
(45) Date of Patent: Feb. 28, 2006

(54) BACKREST FOR ARMCHAIRS

(75) Inventor: Jose Figueras Mitjans, Barcelona (ES)

(73) Assignee: Figueras International Seating, S.A., Barcelona (ES)

( * ) Notice: Subject to any disclaimer, the term of this patent is extended or adjusted under 35 U.S.C. 154(b) by 0 days.

(21) Appl. No.: 10/480,580

(22) PCT Filed: Apr. 23, 2002

(86) PCT No.: PCT/ES02/00195

§ 371 (c)(1),
(2), (4) Date: May 19, 2004

(87) PCT Pub. No.: WO02/100216

PCT Pub. Date: Dec. 19, 2002

(65) Prior Publication Data

US 2004/0195897 A1 Oct. 7, 2004

(30) Foreign Application Priority Data

Jun. 12, 2001 (ES) ..... 200101518 U

(51) Int. Cl.
*A47C 7/38* (2006.01)

(52) U.S. Cl. ..... 297/391; 297/220; 297/397

(58) Field of Classification Search ..... 297/219.1, 297/221–223, 283.4, 394, 3.96, 399, 391, 297/397, 440.1, 440.2
See application file for complete search history.

(56) References Cited

U.S. PATENT DOCUMENTS 3,454,303 A * 7/1969 Dangauthier ..... 297/396
3,556,592 A * 1/1971 Antoine ..... 297/440.2
3,697,133 A * 10/1972 Wolofski ..... 297/452.32
4,072,346 A 2/1978 Schueler
4,619,725 A * 10/1986 Muraishi et al. ..... 156/182
5,110,186 A * 5/1992 Clark et al. ..... 297/440.2
5,139,310 A * 8/1992 Itoh ..... 297/391
5,328,244 A 7/1994 Ishihara et al.
5,897,167 A * 4/1999 Keith ..... 297/397
6,183,045 B1 * 2/2001 Marfilius et al. ..... 297/391
6,305,747 B1 * 10/2001 Mei ..... 297/354.11
6,394,552 B1 * 5/2002 Su ..... 297/410
2004/0095009 A1 * 5/2004 Fisher et al. ..... 297/440.2

FOREIGN PATENT DOCUMENTS

| | | |
|---|---|---|
| EP | 238 770 | 9/1987 |
| EP | 04354968 | 12/1992 |
| EP | 11005479 | 1/1999 |
| ES | 1 038 456 | 7/1998 |
| JP | 05262184 A * | 10/1993 |
| JP | 06090835 A * | 4/1994 |

* cited by examiner

*Primary Examiner*—Peter M. Cuomo
*Assistant Examiner*—Stephen D'Adamo
(74) *Attorney, Agent, or Firm*—Dennis G. LaPointe

(57) ABSTRACT

Backrest for armchairs, made up of a soft front body (1.1) and a rear frame (1.2), situating at the upper part a headrest made up of a respective soft front body (3.1) and a respective rear frame (3.2), fitting the soft body (3.1) of the headrest in a notch (11) of the upper part of the soft body (1.1) of the backrest, with fixing of the mentioned soft body (3.1) of the headrest over the hooks (9) of the corresponding rear frame (3.2) and a screwed anchoring (14) which passes through the frame (3.2) of the headrest and the frame (1.2) of the backrest.

1 Claim, 6 Drawing Sheets

BACKREST FOR ARMCHAIRS

FIELD OF THE INVENTION

The present invention refers to a backrest for armchairs of the ones situated in show and conference rooms, including a disposition which determines the assembly of a headrest header according to an advantageous realization.

BACKGROUND OF THE INVENTION

The armchairs which are used in show and conference rooms at present are sometimes foreseen of headrests so as to offer some more comfortable conditions for the user, being the backrest normally made up of a set which includes a soft front body and a rear frame.

The headrest can be made up directly at the upper part of the backrest, or it can be an independent element which is incorporated in an accessory way and with disassembly possibility.

In the case of headrests which build an only piece with the backrest, the constructive realization of the set is complicated and expensive, moreover with the inconvenience that the headrest cannot be separated from the backrest, not being it possible to individually clean or substitute one or the other independently.

In the case of the headrests made up of an element which is independent from the backrest the fixing of the mentioned headrests is carried out, according to a conventional solution by means of some rods leaving the headrest which are introduced in receiving connections included in the backrest; which has the inconvenience that the headrests can easily be disconnected, being it possible that any unauthorized people can take them away, being this a problem in public places, which is where the mentioned armchairs are normally situated.

SUMMARY OF THE INVENTION

With the structural solution of the backrest object of the invention, the mentioned inconveniences of the headrest disposition of the conventional realizations are solved, based on a novel realization of the assembly disposition.

The backrest object of the invention is made up, as it is already known, of a soft front body and a rear frame, determining the soft body a notch or recess, where a respective soft element, component of the headrest, is fitted in and which establishes moreover a fitting respect to a corresponding rear frame, with fixing on it by means of hooks, establishing moreover through the mentioned frame a screwed fastening with respect to a frame which is solidarity included in the soft element of the headrest at the same time, by means of this fastening the fixing anchoring of the headrests is determined in the disposition respect to the backrest.

This way a headrest disposition is obtained which is easy to assemble, which can be even with the backrest or stand out upwards and even with the soft element inserted centrally along the whole height of the backrest, with possibility, in any case, to be disassembled for its cleaning or the particular substitution of any of the individual elements of the headrest or of the backrest.

The disassembly of the headrest requires however a practical manipulation, which hinders that it can be taken away by any unauthorized people in an unscrupulous way.

In view of all this, the mentioned backrest object of the invention certainly has some very advantageous features, acquiring own life and preferable character respect to the known realizations of the backrests of the same type.

DETAILED DESCRIPTION OF THE INVENTION

The object of the invention refers to a backrest for armchairs, particularly of the ones used in show and conference rooms, including a set (1) of the backrest itself, which is situated fastened respect to a supporting structure (2) anchored to the ground, while at the upper part it incorporates a headrest (3) for the user's comfort.

The shape and dimensions of the backrest set (1) as well as the supporting structure (2) and the headrest (3) itself, can vary without altering the concept which is pretended to claim, which is the disposition of the headrest assembly (3) respect to the backrest set (1).

Figure 1:
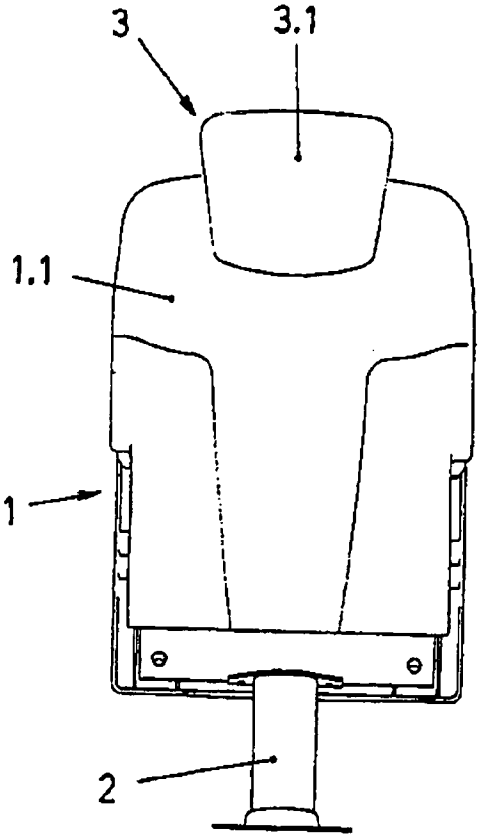
FIG. 1 shows a front view of an armchair backrest according to the invention.
Figure 2:
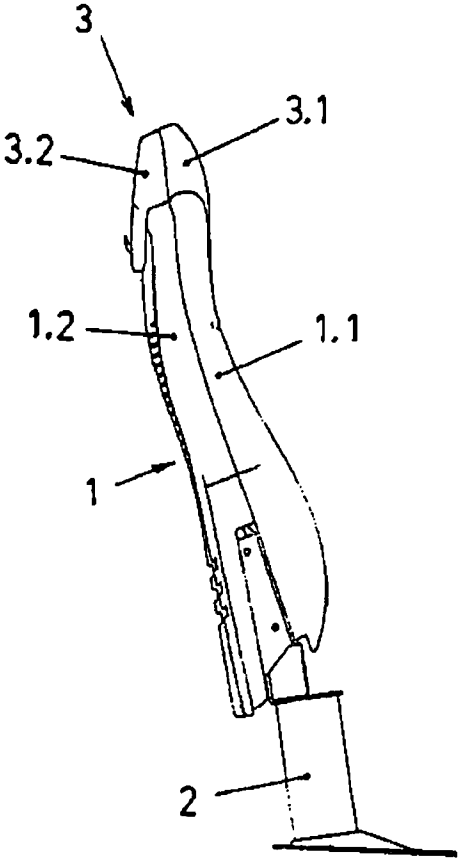
FIG. 2 is a corresponding view in profile respect to the previous figure.
Figure 3:
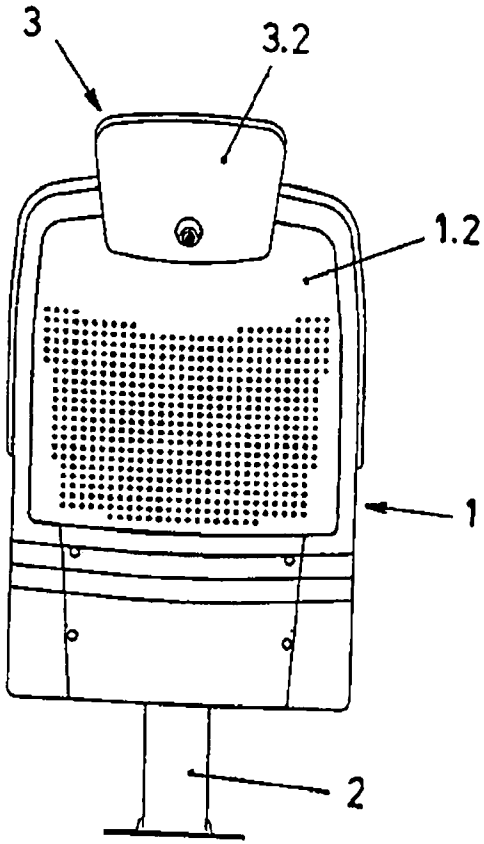
FIG. 3 is a respective rear view of the previous backrest.
Figure 4:
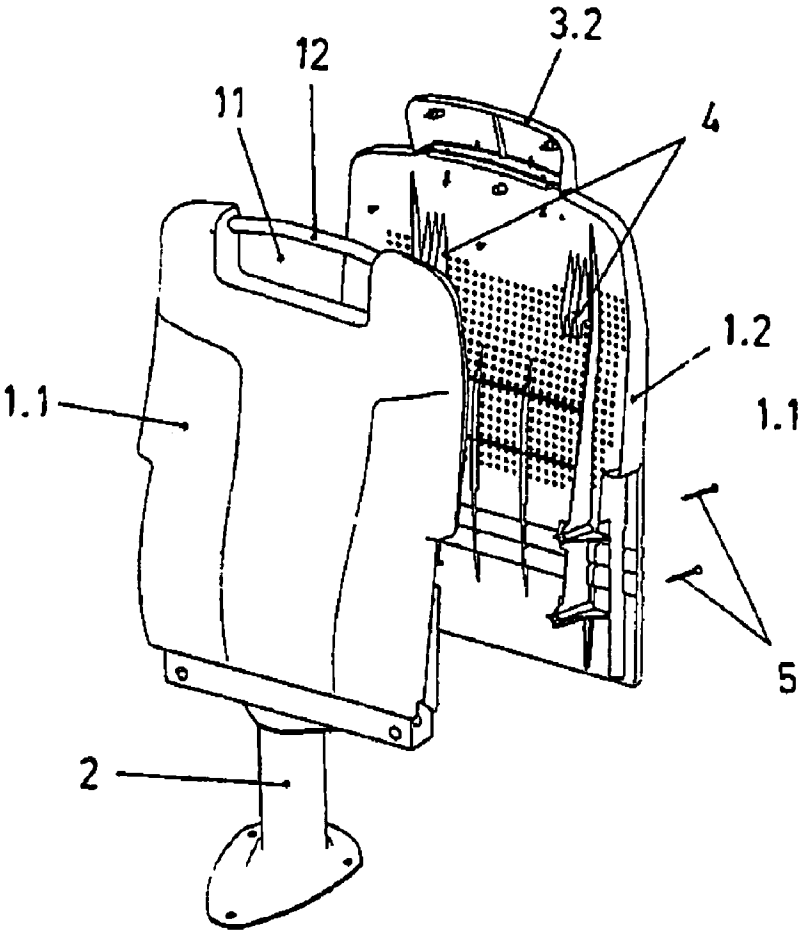
Figure 7:
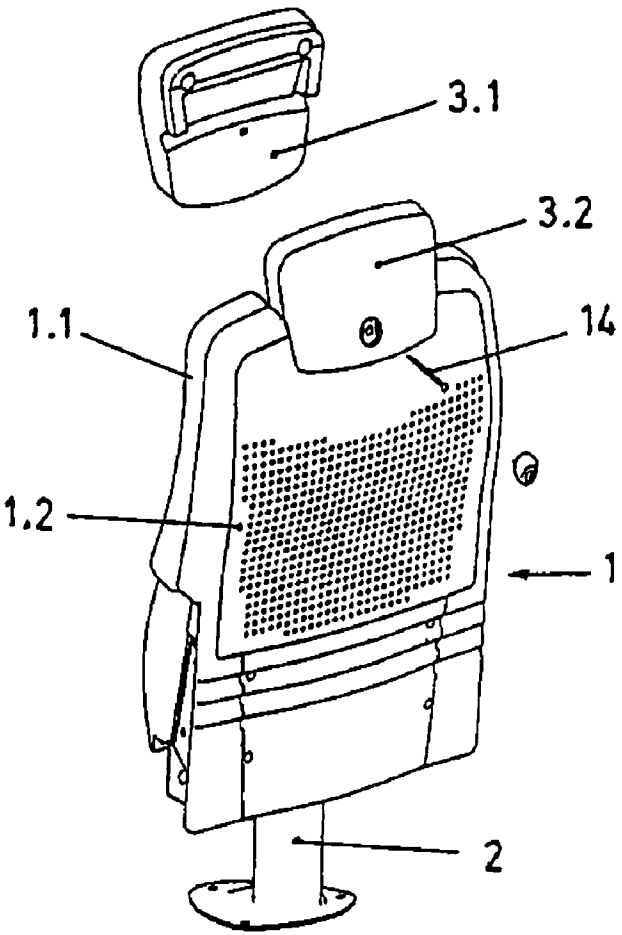
FIGS. 6 and 7 are both front and rear perspectives of the backrest, with the front element of the headrest separated from its assembled position.
Figure 6:
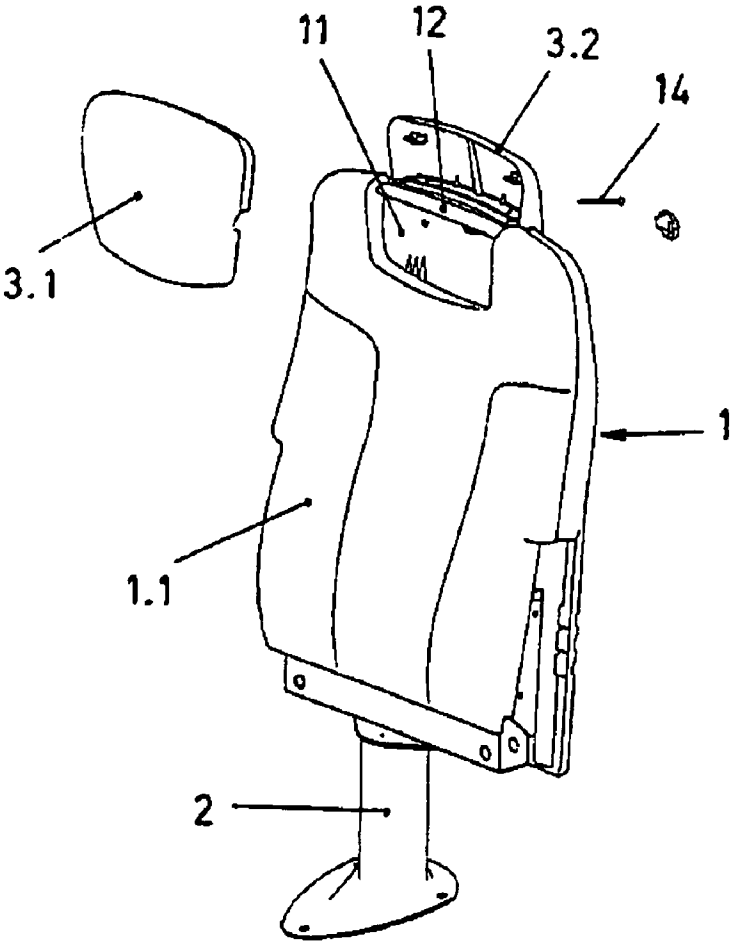

The backrest set (1) is made up of a soft front body (1.1) and a rear frame (1.2), these elements are correspondingly connected to one another, establishing a fixed fastening between them by means of hooking between the respective reciprocal conformations (4) and anchoring by means of screwed fastening (5), in the way shown on FIGS. 3 and 4.

The headrest (3) includes in turn a soft front element (3.1) and a respective rear frame (3.2), these elements are also correspondingly connected to one another, establishing the fixing between them by means of some retaining hooks at the upper part and a screwed fastening at the lower part.

Figure 8:
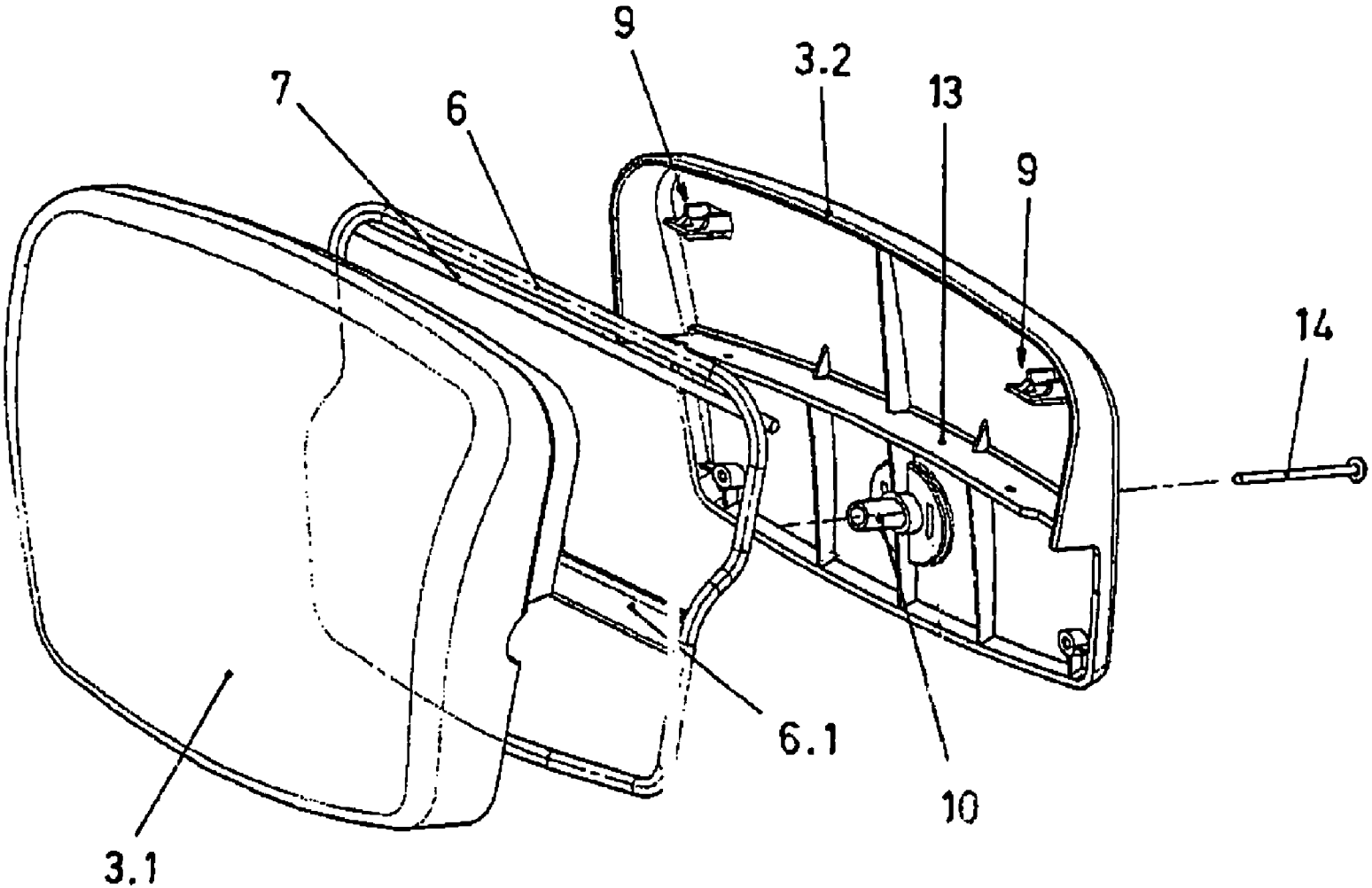
FIG. 8 is an exploded perspective of the component set of the headrest for the backrest according to a realization example.
Figure 10:
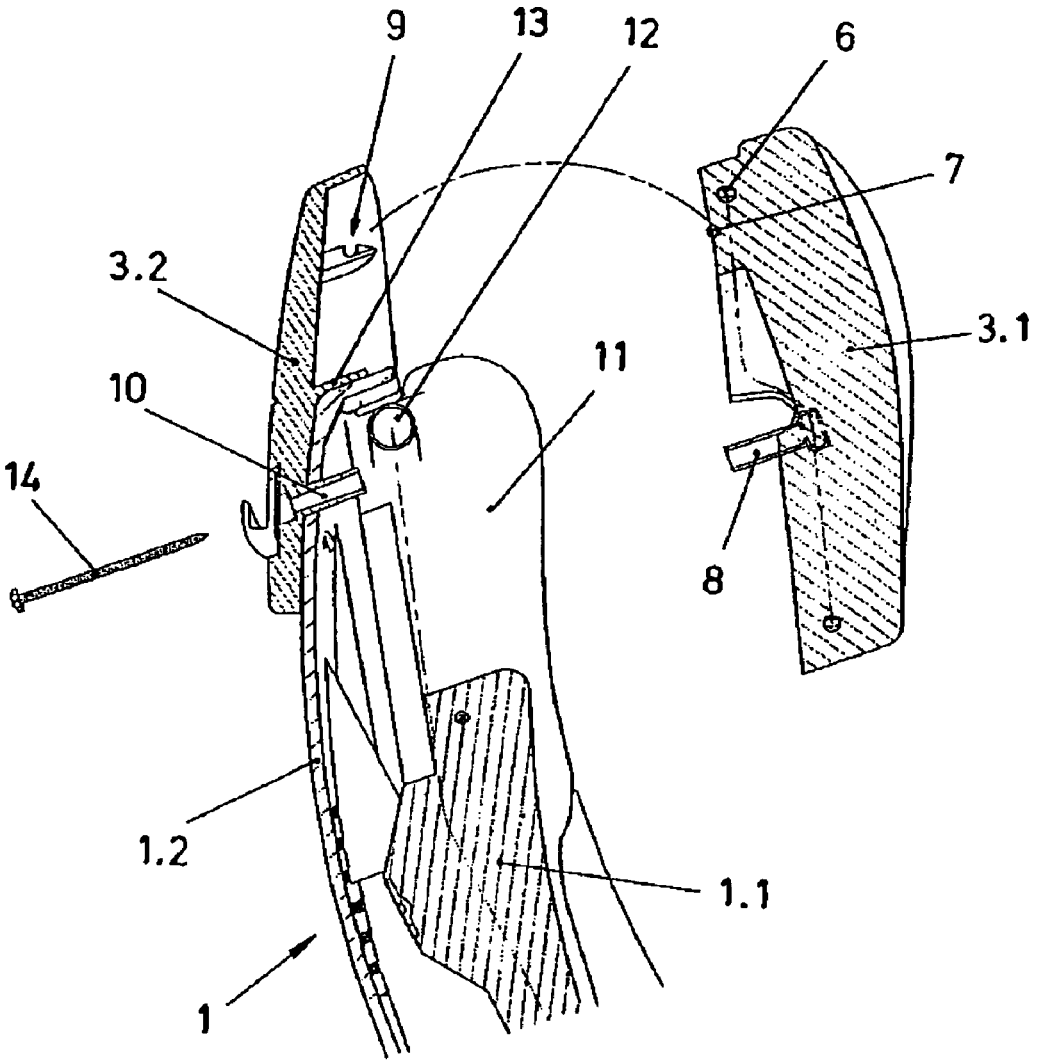
FIG. 10 is an amplified detail of the upper part of the backrest, in section and with the front element of the headrest separated from its assembly position.

To the effects the soft element (3.1) component of the headrest (3) includes absorbed in its material a structure (6), as it is shown in exploded detail in FIG. 8, which has solidarity at the upper part a transversal bar (7), while lower it has a crossbar (6.1), on which a bushing (8) is solidarity threaded internally, and which leaves towards the rear part of the soft element (3.1), as it is observed on FIG. 10.

The frame (3.2) component of the headrest (3) determines at the internal upper part some conformations (9) in the way of hooks, respect to which the fastening of the bar (7) of the frame (6) of the soft element (3.1) is possible, while the mentioned frame (3.2) has beyond a hollow bushing (10), which in the assembly disposition corresponds faced with the bushing (8) of the frame (6) of the soft element (3.1).

Figure 5:
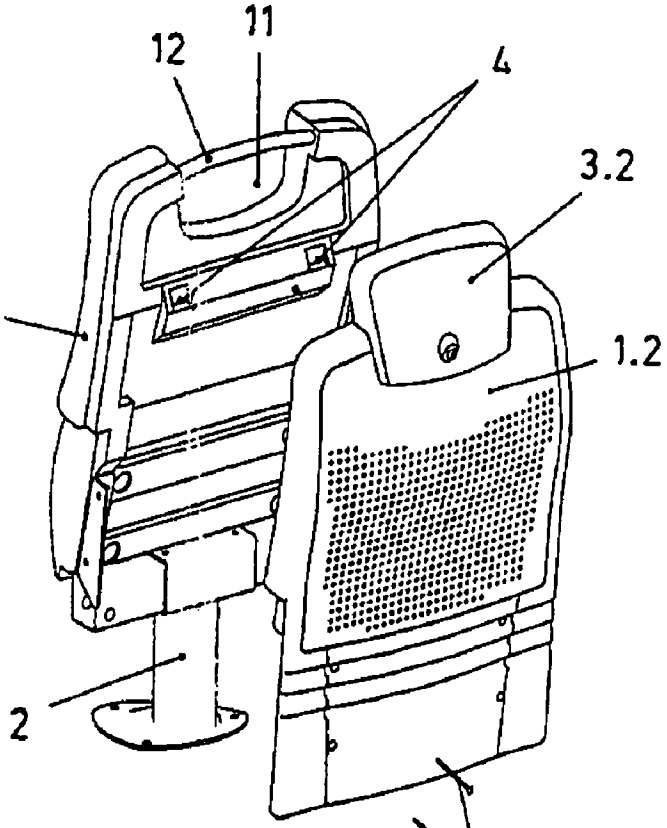
FIGS. 4 and 5 are both front and rear perspectives of the same backrest, with the rear frame moved respect to the front body and without the front element of the headrest.

The soft front body (1.1) of the backrest set (1) determines at the upper part a notch or recess (11), where the fitting of the soft headrest (3) element (3.1) is possible; having the mentioned soft front body (1.1) of the backrest set (1) a frame (12) which passes transversely through the recess (11), as it can be observed on FIGS. 4 and 5.

Figure 9:
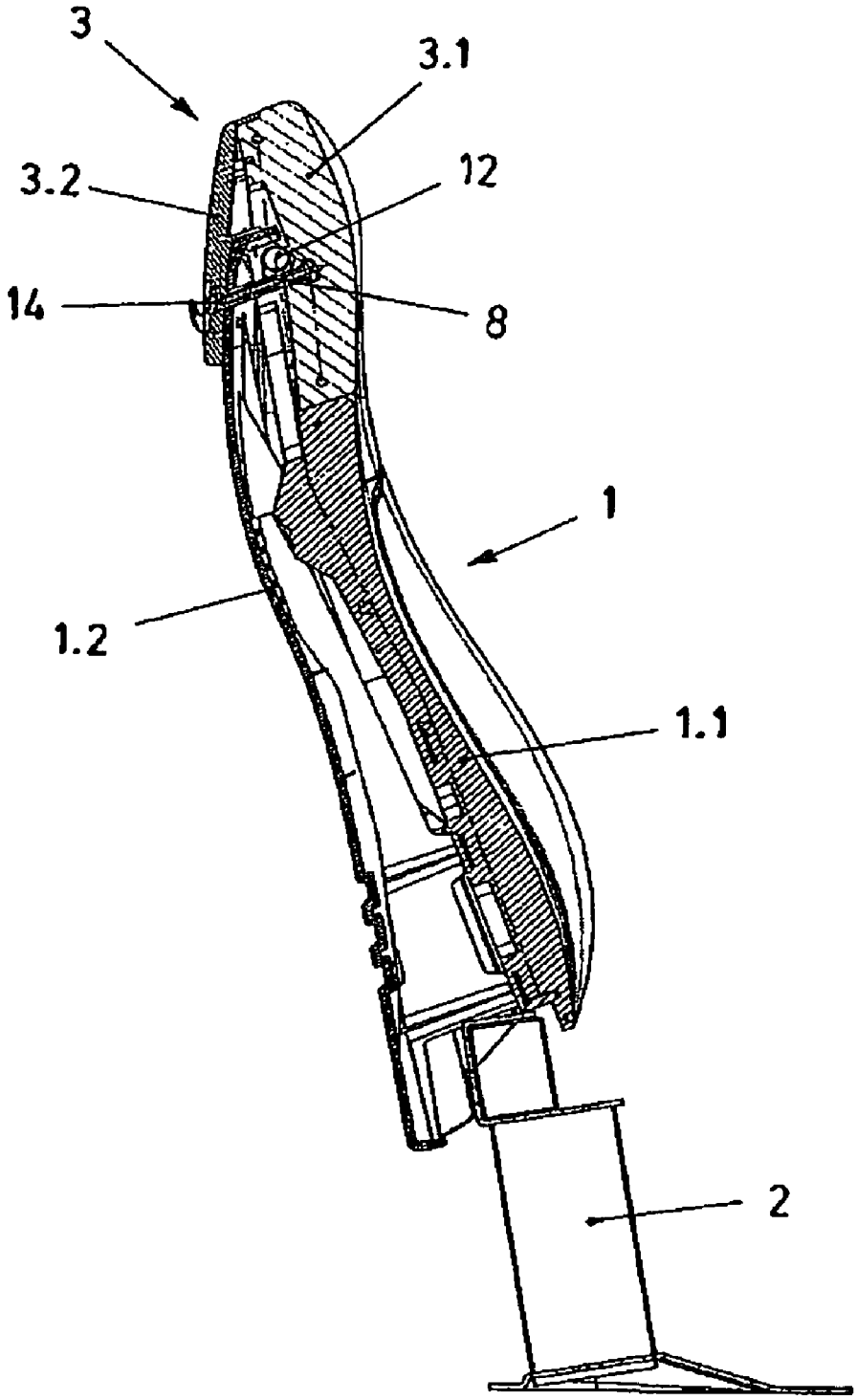
FIG. 9 is a view in longitudinal section of the preconized backrest.

In the assembly disposition, the frame (3.2) component of the headrest (3) is situated partially superposed at the back at the upper part of the rear frame (1.2) of the backrest set (1), as it can be observed on FIGS. 9 and 10, passing the hollow bushing (10) of the mentioned frame (3.2) of the headrest (3) through a hole in the rear frame (1.2) of the backrest set (1), while a transversal wall (13) of the inside of the mentioned body (3.2) of the headrest (3) is supported on the upper edge of the mentioned rear frame (1.2) of the backrest set (1).

Once this way, on the front part, the soft element (3.1) of the headrest (3) is incorporated, fitting the mentioned soft element (3.1) in the frame (3.2) so that the bar (7) of the structure (6) hooks in the conformations (9) of the mentioned frame (3.2), and once established the hooking the soft element (3.1) is tilted so that it fits perfectly in the recess (11) of the soft front body (1.1) of the backrest set (1).

In that disposition the threaded bushing (8) of the structure (6) of the soft element (3.1) opposedly corresponds with the hollow bushing (10) of the frame (3.2) so that through them a anchoring fastening can be established by means of a screwing element (14), assuring this way the fixing of the assembly.

As it is observed on FIG. 9, the threaded bushing (8) of the structure (6) of the soft element (3.1) remains in touch under the upper transversal section of the frame (12) of the soft front body (1.1) of the backrest set (1), with which a vertical retention against the established hooking over the conformations (9) of the frame (3.2) is established, not allowing the disconnection.

The represented realization only corresponds to an example of the headrest shape (3), without limitative character, as within the concept of the invention, which refers to the connection disposition and fastening of the headrest respect to the backrest set (1), the mentioned headrest (3) can also have other shapes, such as for example, according to an even configuration with the upper part of the backrest set (1), or with an extension of the soft element (3.1) hooked along the whole height of the soft front body (1.1) of the backrest set (1), or any other compatible shape with the particular headrest (3) assembly according to the invention.

What is claimed is:

1. A backrest for armchairs comprising:

a soft front body (1.1) and a rear frame (1.2) correspondingly connected to define a backrest set (1), located at an upper part of said connected soft front body (1.1) and said rear frame (1.2) is a headrest (3) which includes a respective soft front element (3.1) and a respective rear frame (3.2), wherein the soft front element (3.1) of the headrest (3) is adapted to be hooked in an upper notch or recess (11) of the soft front body (1.1) of the backrest set (1) by fastening the soft front element (3.1) of the headrest (3), with respect to the corresponding rear frame (3.2) of the headrest (3), by means of retention hooking at the upper part and a lower screwed fastening which is established through the rear frame (1.2) of the backrest set (1), and the soft front element (3.1) of the headrest (3) further comprising:

a frame (6), to which a bar (7) is solidarily incorporated at its upper part and adapted to engage mating conformations (9) in an interior part of the rear frame (3.2) of the headrest (3), said conformations (9) being in the shape of hooks and adapted to receive said bar (7), an internally threaded bushing (8) located at a lower level of the soft front element (3.1) is integrally fixed to the frame (6) and is oriented toward a back of the headrest (3), and a hollow bushing (10) located in the rear frame (3.2) of the headrest (3), said bushing (10) being oriented inwardly and passes in the assembly through a hole in the rear frame (1.2) of the backrest set (1), such that the bushing (10) faces the threaded bushing (8) of the soft front element (3.1) and is aligned for insertion of anchoring fastener (14) through said bushing (10) and said threaded bushing (8), wherein through the recess (11) of the soft front body (1.1) of the backrest set (1), a transversal section of a structure (12) included in the soft front body (1.1) passes transversely across said recess (11), and the threaded bushing (8) of the soft front element (3.1) remains supported in assembly disposition below and abutted against the transversal section of the structure (12), defining a vertical retention which does not allow the disconnection of the bar (7) with respect to said conformations (9) of the rear frame (3.2) of the headrest (3).

* * * * *